US008783534B1

(12) United States Patent
Marshall

(10) Patent No.: US 8,783,534 B1
(45) Date of Patent: Jul. 22, 2014

(54) LADDER SUPPORT DEVICE

(71) Applicant: Ronald E. Marshall, Tampa, FL (US)

(72) Inventor: Ronald E. Marshall, Tampa, FL (US)

( * ) Notice: Subject to any disclaimer, the term of this patent is extended or adjusted under 35 U.S.C. 154(b) by 0 days.

(21) Appl. No.: 13/734,372

(22) Filed: Jan. 4, 2013

Related U.S. Application Data

(60) Provisional application No. 61/631,505, filed on Jan. 5, 2012.

(51) Int. Cl.
*A45F 5/00* (2006.01)

(52) U.S. Cl.
USPC ..... 224/269

(58) Field of Classification Search
USPC ..... 224/268–270
See application file for complete search history.

(56) References Cited

U.S. PATENT DOCUMENTS

| | | | | |
|---|---|---|---|---|
| 2,651,441 | A | 9/1953 | Rau et al. | |
| 3,285,482 | A | 11/1966 | Bedsaul, Sr. | |
| 3,638,843 | A * | 2/1972 | Ortynski | 224/199 |
| 4,319,704 | A | 3/1982 | Rosen | |
| 4,453,442 | A * | 6/1984 | LaFlame | 84/421 |
| 4,949,889 | A | 8/1990 | Carson | |
| 5,232,136 | A * | 8/1993 | Unger | 224/247 |
| 5,452,830 | A | 9/1995 | Hopkins et al. | |
| 5,489,051 | A * | 2/1996 | Robinson | 224/148.4 |
| 5,511,705 | A * | 4/1996 | Dreszer | 224/666 |
| 5,511,707 | A | 4/1996 | Reichert | |
| 5,687,892 | A | 11/1997 | Johns | |
| 5,697,537 | A | 12/1997 | Bowlsby | |
| 5,826,763 | A * | 10/1998 | Roberts | 224/270 |
| 6,062,449 | A | 5/2000 | Kahn | |
| 6,193,125 | B1 * | 2/2001 | Grover | 224/575 |
| D450,449 | S * | 11/2001 | Godshaw et al. | D3/228 |
| 6,443,342 | B1 | 9/2002 | Kahn | |
| 6,454,147 | B1 | 9/2002 | Marks | |
| 6,508,390 | B1 * | 1/2003 | Karpati | 224/270 |
| 7,175,061 | B2 | 2/2007 | Dohn | |
| 7,290,689 | B2 * | 11/2007 | Oxley | 224/270 |
| 2004/0178240 | A1 | 9/2004 | Bauer | |
| 2004/0178241 | A1 * | 9/2004 | Kostal et al. | 224/269 |
| 2005/0161479 | A1 * | 7/2005 | Licsko | 224/270 |
| 2005/0205625 | A1 | 9/2005 | House | |
| 2006/0011681 | A1 | 1/2006 | Raimondo et al. | |
| 2007/0017945 | A1 * | 1/2007 | Willis | 224/270 |
| 2007/0125814 | A1 | 6/2007 | Roh | |
| 2010/0072242 | A1 | 3/2010 | Panosian et al. | |
| 2010/0206926 | A1 | 8/2010 | Mekis | |
| 2011/0253757 | A1 | 10/2011 | May, Jr. | |

* cited by examiner

*Primary Examiner* — Brian D Nash
(74) *Attorney, Agent, or Firm* — Frijouf, Rust & Pyle, P.A.

(57) ABSTRACT

A ladder support device is disclosed for engaging a ladder. The ladder supporting device comprises a base plate having a first hanger plate and a second hanger plate extending from the base support plate. A first retainer plate and a second retainer plate extend from the first hanger plate and the second hanger plate respectively. A clip plate extends from the base plate for receiving the waistband and securing the base plate to the individual. The base plate, the first hanger plate and the first retainer plate define a first carriage for engaging the step of the ladder. The base plate, the second hanger plate and the second retainer plate define a second carriage for engaging the first stringer or the second stringer of the ladder.

14 Claims, 10 Drawing Sheets

LADDER SUPPORT DEVICE

CROSS-REFERENCE TO RELATED APPLICATIONS

This application claims benefit of U.S. Patent Provisional application No. 61/631,505 filed Jan. 5, 2012. All subject matter set forth in provisional application Ser. No. 61/631,505 is hereby incorporated by reference into the present application as if fully set forth herein.

BACKGROUND OF THE INVENTION

1. Field of the Invention

This invention relates to support devices and more particularly to the ladder support device.

2. Background of the Invention

Since primitive ladders were developed 10,000 years ago in the Mesolithic period, they have provided man to have the ability to reach heights previously unattainable. The development of modern ladders has been attributed to the Hebrews and Egyptians. Since their inception, ladders have been primarily used as a tool. As such, they are generally used in conjunction with another tool or tools to perform a particular job function.

The requirement to transport both a ladder and a tool or tools to a worksite presents a problem for the workman. The need for transporting multiple tools led to the development of many devices such as carts and wagons, and more particularly tool belts as is well known to those skilled in the art. Several physiology studies have shown that carrying a heavy load around the waist causes minimal deviations in gait of a subject when compared to a normal gait. Likewise back injuries are minimized by centering the load at the waist rather than the shoulders since compression of spinal discs is eliminated. Therefore, the ability to carry a ladder with the load centered on the waist of a workman presents a problem to be solved by those skilled in the art.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 2,651,441 to Rau et al. discloses a shoulder-suspended carrier for plate-form building material adapted to be used by one of a pair of bearers to support one end of a heavy load in an upright plane leaning against the near side of the bearers' bodies with the bottom edge of the load substantially knee-high. Each bearer will have hands free for grasping the end and top edges of the load to steady the same. The carrier comprises a body harness including a pair of mutually cooperative primary suspension slings of loop form. One of the slings is adapted to embrace and hang directly leaning downward from the bearer's near shoulder and rest wall, so as to facilitate unloading or unloading of the carriers for transportation of a wall-board unit load in the manner depicted. The other sling is adapted to embrace the bearer's off shoulder and body and to extend diagonally across the body to a point of convergence with the first-mentioned sling alongside the near hip flank. A concentration member of ring form is fixedly connected to and supported by the diagonal off shoulder suspension sling at the point of convergence of both slings and having the near shoulder suspension sling threaded therethrough for free sliding adjustment. A retainer strap to prevent the near shoulder suspension sling from slipping off the shoulder. The retainer strap has its opposite ends engaged respectively with the front and rear reaches of the near shoulder suspension sling and is adapted to extend around the off side of the bearer's body. The retainer strap may be tightened and loosened in its body embracing grip by lengthwise manual adjustment of the near shoulder suspension sling through the concentration ring. The load-engaging means is supported by the concentration member.

U.S. Pat. No. 3,285,482 to Bedsaul, Sr. discloses an arcuate horizontally disposed bar having outwardly curved ends. An upper hook extends upwardly from the intermediate portion of the arcuate bar and is mounted in an inverted position. A horizontally disposed bar also extends from the intermediate portion of the arcuate bar, and an open hook is carried by the horizontally disposed bar depending from the outer end thereof and spaced from the arcuate bar.

U.S. Pat. No. 4,319,704 to Rosen discloses a support member adapted to be worn on a person's belt to assist in supporting bulky or heavy packages. The support member includes an upper roughened surface for supporting the package which surface is inclined upwardly in a direction away from the wearer's body. Extending downwardly from the inner portion of the supporting surface is a generally vertical member which includes therein a slotted portion suitable for engagement with the wearer's belt. Disposed below the slotted vertical member is a body engaging surface which bears against the person's body when a package is supported on the upper inclined surface of the support member.

U.S. Pat. No. 4,949,889 to Carson discloses an apparatus for releasably mounting an auxiliary compressed air tank to a breathing apparatus of the type having a main compressed air tank. The apparatus includes a bracket having a pair of mounting legs connected in relatively closely spaced facing relation to one another defining a strap receiving area and means for clamping one of the mounting legs rigidly with the other mounting leg spaced outwardly therefrom. One of the mounting legs is selectively insertable and removable from a disposition between .the main compressed air tank and a securing strap of a harness which supports the main compressed air tank on a user. The harness strap is received in the strap receiving area and the strap is tightened to hold the auxiliary tank relative to the main tank. To release the auxiliary tank, the strap is loosened and the mounting leg is moved to clear the strap.

U.S. Pat. No. 5,452,830 to Hopkins et al. discloses a holder for implements such as a mortar board, which is to be horizontally positioned, knives, such as broad, spackle, and shear knives, which are to be positioned at an angle, and a roll of drywall tape, vertically positioned. The holder comprises a back plate to secure implements, and a second plate in which the implement holder is temporarily attached to the user, more specifically, the waist area of the user. The mortar board is inserted into the Y-shaped slots which are horizontally aligned to the back plate and are disposed in spaced relationship. The knives are inserted into the compression loaded slots having adjacent relationship and positioned at an angle from the back plate. The tape is inserted into the J-shaped hook which is spaced away from the back plate to allow for the tapes positioning and removal to and from the implement holder. The parts which comprise the implement holder are made from a rigid material, preferably aluminum. When the implements are engaged in their appropriate locations within the implement holder, both hands of the worker are free to conduct other operations.

U.S. Pat. No. 5,511,707 to Reichert discloses a device used to assist a person in carrying heavy, bulky, box-like objects having essentially square corners. The device is attached to the person such as by attachment to a belt or pants or the like. The device is preferably of one piece construction having a vertical and horizontal portion. The vertical portion has a metal clip or the like for attachment to the person and a horizontal or shelf like portion extends outwardly at approximately 90 degrees from the vertical portion and has a 90 degree or "V" notch formed therein into which a corner of a box-like structure is placed for carrying and thereby limiting the load on the hands and arms of the person carrying the object.

U.S. Pat. No. 5,687,892 to Johns discloses a belt mounted tool hanger comprising a base member having a slot therein through and within which a portion of a workman's belt can be engaged and a hook which extends from a end edge of the base member, across same, and to a level above the height to which the base member extends.

U.S. Pat. No. 5,697,537 to Bowlsby discloses a bow holder which can attach to any hunter's waist either through belt loops or by tucking behind the belt or inside the waistband of the hunter's pants. The bow holder is built on a stabilizing plate which extends downward to support the holder against the hunter's leg. The bow rests on top of a generally horizontal base area, held from slipping sideways by a lip. The base is provided with a notch to receive the bow's stabilizer bar or a simple bolt screwed into the stabilizer bar fitting. The notch is preferably inclined to the vertical, such that the bow string is inclined inwardly toward the hunter's upper body, and the stabilizer bar or nocked arrow point is angled outwardly from the hunter's leg. The provision of a second angled notch on the opposite side of the base from the first notch allows the bow to be carried with its center of gravity either in front of or behind the holder which changes the angle of the bow axis from a tilted-forward "ready" position to a tilted-back "transport" position.

U.S. Pat. No. 6,062,449 to Kahn discloses a tool-toting device for carrying and retaining a hand tool comprising a clip, a swivel element and a U-shaped hook, the clip being capable of attachment to a belt, such as a tool belt. The swivel element is swivelably connected to the clip by conventional means, such as a semi-tubular rivet such that it freely swivels about a 360° axis, while the U-shaped hook is rotatably connected to the swivel element by means of a jam nut-acorn nut arrangement such that it is capable of rotating about a 360° axis. In this manner, a tool hanging from the U-shaped hook will swivel about the 360° axis, thereby maintaining its center of gravity as the user moves about a construction area. The user can re-position the hook for comfort and accessibility simply by rotating the hook about its axis.

U.S. Pat. No. 6,443,342 to Kahn discloses a tool belt tool tote device that is capable of carrying two tools independently, such as a cordless drill and a hammer. The double tool tote device comprises a C-shaped clip, a terminal swivel element and two hook elements. In use, a tool depending from each hook may freely swivel to maintain its center of gravity so that the tool will remain securely attached to the tool tote while remaining easily accessible to the user. In addition, each hook element is rotatably positionable to permit the user to independently position each tool in a comfortable fashion. The two hook elements also can be selectively positioned to retain one tool element across the breadth of the two hook elements.

U.S. Pat. No. 6,454,147 to Marks discloses a personal tool carrying device providing improvements in manufacture and appearance. A hook includes an integrally formed head end that is supported by ribs of a slot of a housing. A friction cap preferably surrounds the head end to hold the hook in a selected rotational position. The head end and friction cap are held in a cavity of the housing by a mounting element such as a belt clip. The housing swivels in relation to the mounting element. The device provides various surfaces for product identifying information.

U.S. Pat. No. 7,175,061 to Dohn discloses a hook-like carrier adapted for attachment to and support by the belt of a user including an attachment member having a pair of generally vertical, spaced slots which are adapted to receive the user's belt. Attached to an outer portion of the attachment member is a first element of a foldable hook. The first hook element is pivotally coupled to a second hook element such as by a first hinge and the second hook element is, in turn, pivotally coupled to a third hook element, such as by a second hinge. The hook elements are pivotally movable between a first folded configuration, such as when not in use, and a second extended configuration for engaging and supporting an article and maintaining the article securely in position in closely spaced relation to the user's waist.

United States Patent Application 2004/0178240 to Bauer discloses a simplified tool/accessory toting device facilitating the carrying and retention by an individual of a hand tool or other accessory having a loop for attaching the device to a belt. A rigid hook extends from the loop and has the ability to be shifted as the individual moves to maintain a good center of gravity for the accessory attached to the hook. Rigidity of the hook ensures the individual that the accessory can easily be placed on the toting device or to remove it with one hand. The hook can be placed in a comfortable manner so as to permit the individual to position the hook on a persons belt either on the right or left side.

United States Patent Application 2005/0205625 to House discloses a container support device including a first part configured to interact with a user's article of clothing and a second part configured to interact with and/or support a container. The first part interacts with the user's clothing and the second part interacts with and/or supports the container, at least a portion of the container's weight is supported by the user's clothing.

United States Patent Application 2006/0011681 to Raimondo et al. discloses a carrier support holder consisting of an integral, unitary member. The holder has a U-shaped component which is configured for placement over the belt or waistband of the user. A second, hook-shaped component extends outward for insertion into a slot, opening, or other convenient space underneath or on the side of an infant or similar carrier, and a third, curvilinear component is designed to be positioned against the user's waist.

United States Patent Application 2007/0125814 to Roh discloses a universal carrying device having a first substantially rectangular cover. A substantially rectangular carrier has an opening. A hinge attaches the first substantially rectangular cover to the first substantially rectangular carrier.

United States Patent Application 2012/2272242 to Panosian et al. discloses a wall organizing system including a generally elongate track. A member is provided for attaching the track to a wall or other substantially vertical surface. At least one attaching member is slidably and selectively movable along the track between opposing lateral ends of the track for attaching to an item to be secured to the wall or other surface.

United States Patent Application 2010/0206926 to Mekis discloses an invention comprising a detachable hook with load bearing surface, which can be utilized by movers of heavy items and boxes to comfortably shift the weight of the load from the movers arms and back to the mover's legs, resulting is much less fatigue and reduced risk of injury.

United States Patent Application 2011/0253757 to May, Jr. discloses a carrying aid that transfers weight from a load supported by shoulder straps, such as a backpack or portable tree stand, to the user's hip area. The carrying aid includes a weight supporting region and a fastener region. The weight supporting region forms a trough around a portion of the load that reduces the risk of the load from being dislodged from the weight supporting region. A fastener attaches the carrying aid to the user's belt. The carrying aid can be molded, shaped, or formed from a single piece of material such as a metal, plastic, or polycarbonate. The carrying aid is easy to attach and remove from the user's belt and the load is easily inserted and removed from the trough formed by the weight supporting region. The carrying aid is lightweight and easily stored when not in use. This carrying aid is particularly useful for deer hunters or nature enthusiasts carrying shoulder strap-supported portable tree stands.

Although the aforementioned prior art have contributed to the development of the art of securing an object to a support member, none of these prior art patents have solved the needs of this art.

Therefore, it is an object of the present invention to provide an improved apparatus for carrying a load and more specifically a ladder.

Another object of this invention is to provide an improved apparatus that is simple for the operator to use.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved ladder support device for engaging a ladder. The ladder includes a first stringer and a second stringer coupled by a plurality of steps. The first stringer and the second stringer have a height, a width and a depth, the steps have a height, a width and a depth. An individual transports the ladder over a surface. The individual has a waistband encircling a waist of the individual.

The ladder supporting device comprises a base plate having an exterior plate surface, an interior plate surface, an upper edge, a lower edge, a first side edge and a second side edge. A first hanger plate extends from the exterior plate surface of the base support plate and has an upper surface, a lower surface, an outer edge, a first side edge and a second side edge. A second hanger plate extends from the exterior plate surface of the base support plate and has an upper surface, a lower surface, an outer edge, a first side edge and a second side edge.

A first retainer plate extends from the outer edge of the first hanger plate and has an exterior plate surface, an interior plate surface, an upper edge, a first side edge and a second side edge. A second retainer plate extends from the outer edge of the second hanger plate and has an exterior plate surface, an interior plate surface, an upper edge, a first side edge and a second side edge. A clip plate extends from the upper edge of the base plate and has an exterior clip surface, an interior clip surface, and an lower edge. The base plate and the clip plate define a clip groove for receiving the waistband and securing the base plate to the individual.

The base plate, the first hanger plate and the first retainer plate define a first carriage for engaging the step of the ladder. The base plate, the second hanger plate and the second retainer plate define a second carriage for engaging the first stringer or the second stringer of the ladder.

In a more specific embodiment of the invention, the first hanger plate has a generally intermediate position relative to the upper edge of the base plate and the lower edge of the base plate. The second hanger plate has a generally adjacent position relative to the lower edge of the base plate. The generally intermediate position and the generally adjacent position define a guiding channel between the first retainer plate and the second retainer plate and a retainer channel between the first hanger plate and the second hanger plate. The guiding channel permits the inputting or outputting of the first stringer or the second stringer into or from the retainer channel only upon positioning the ladder in a general angled orientation. The retainer channel permits vertical displacement of the ladder relative to the base plate only upon positioning the ladder in a generally angled orientation.

In another more specific embodiment of the invention, a first acute angle is located between the upper surface of the first hanger plate and the base plate for maintaining the step adjacent to the base plate. A second acute angle is located between the upper surface of the second hanger plate and the base plate for maintaining the first stringer or the second stringer adjacent to the base plate. The lower surface of the first hanger plate and the exterior plate surface of the base plate define an interior engaging angle. The upper surface of the second hanger plate and the interior plate surface of the second retainer plate define an exterior engaging angle. The interior engaging angle and the exterior engaging angle contact with the first stringer or the second stringer for wedging the ladder within the second carriage.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 7:
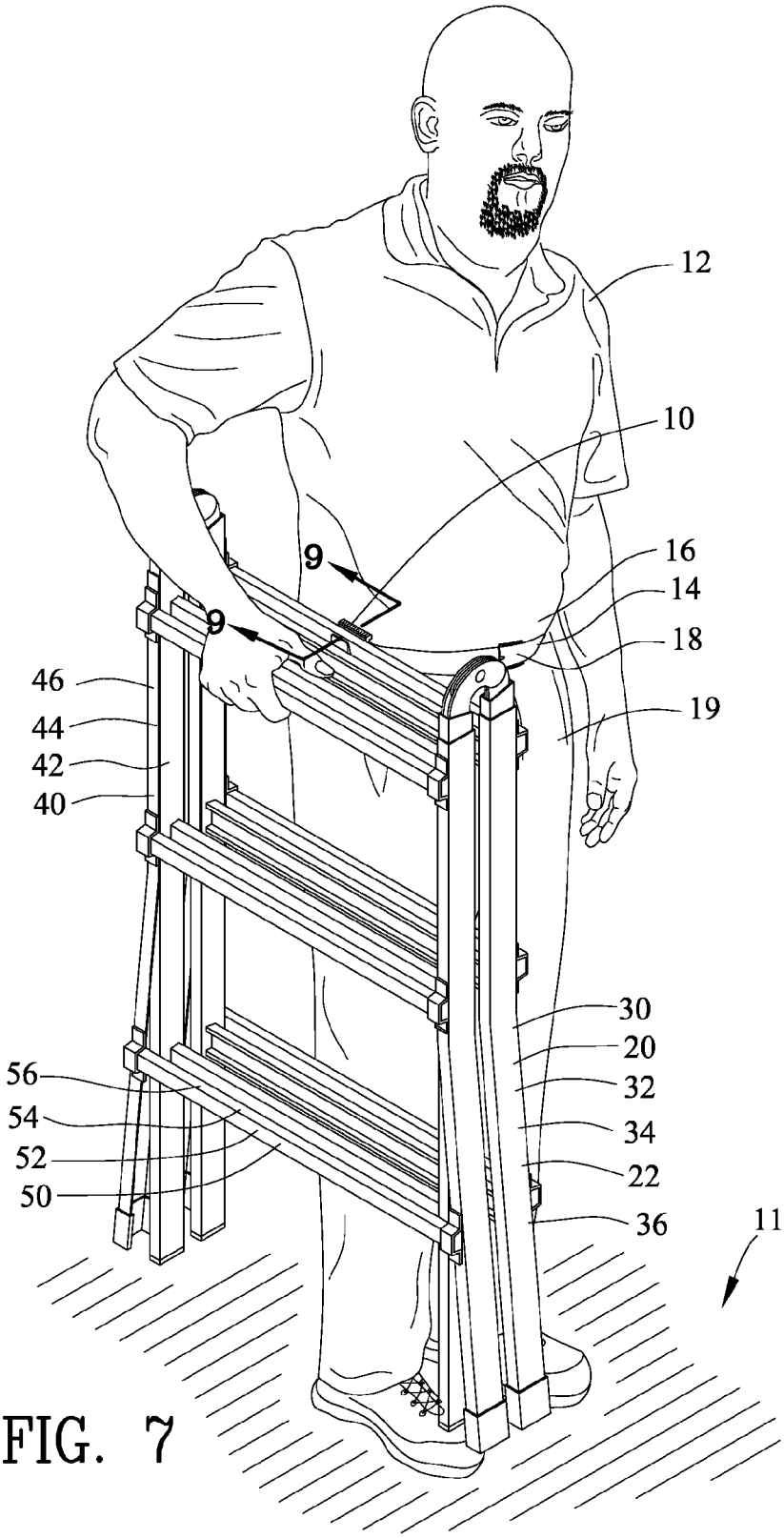
FIG. 7 is a front isometric view of the ladder support device engaging a waistband of an individual wherein a first carriage of the ladder support device is engaging a step of a collapsible extension ladder the ladder.
Figure 8:
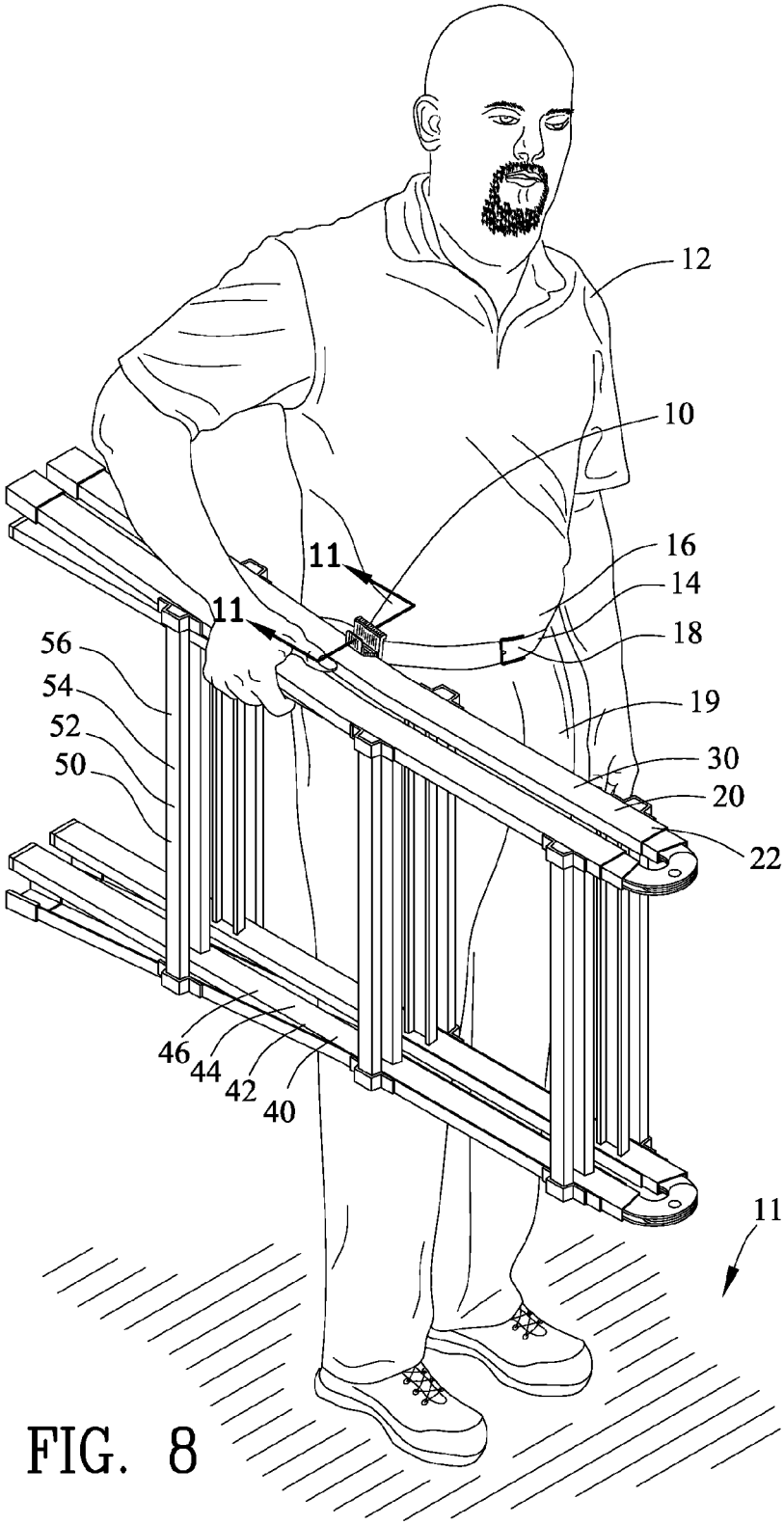
FIG. 8 is a view similar to FIG. 7, wherein a second carriage of the ladder support device is engaging a stringer of the collapsible extension ladder.
Figure 9:
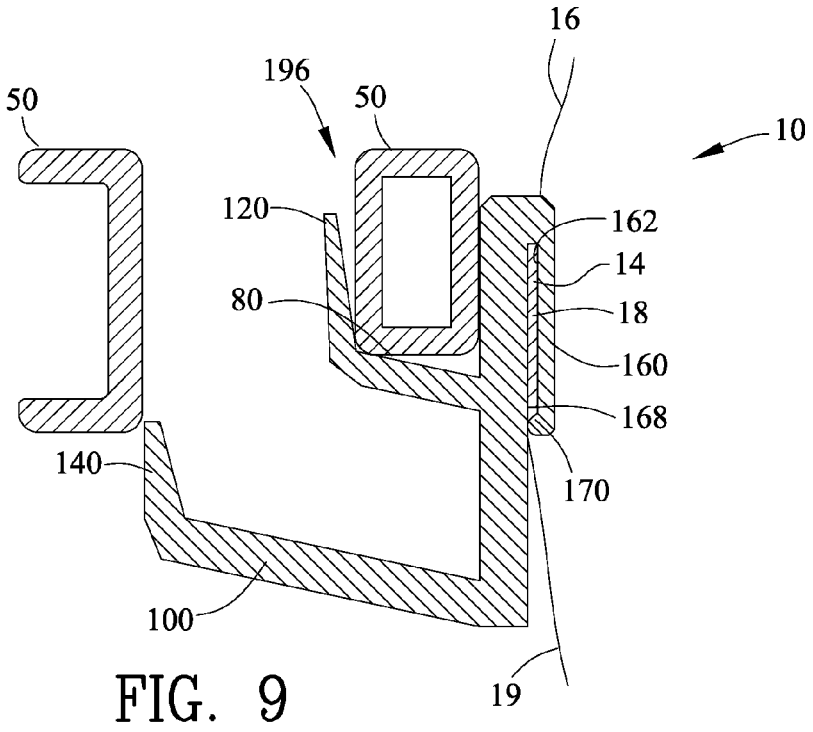
FIG. 9 is a sectional view along line 9-9 in FIG. 7.
Figure 10:
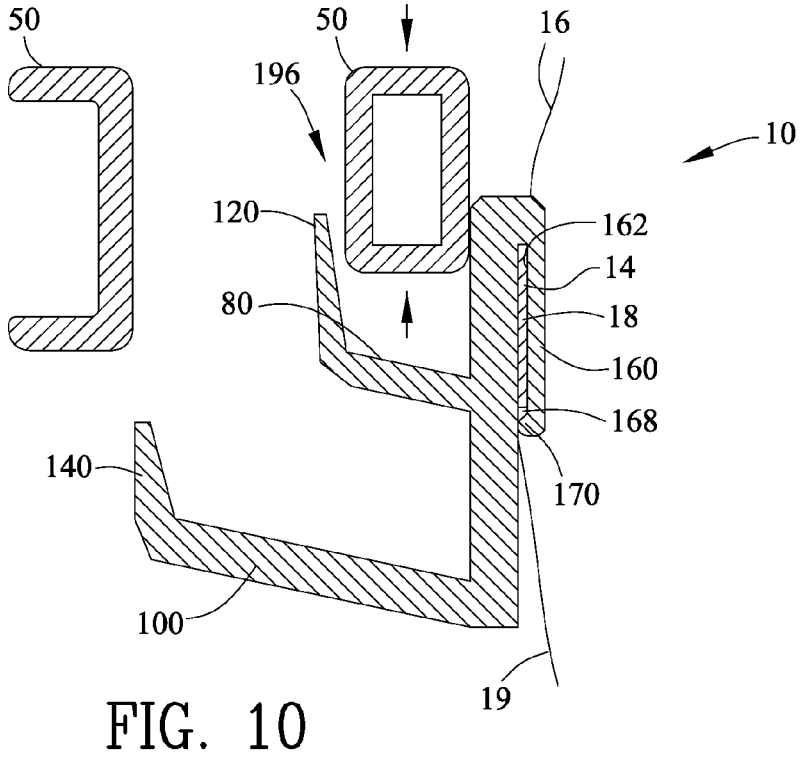
FIG. 10 is a view similar to FIG. 9 illustrating the vertical displacement of the ladder relative to the ladder support device for inserting and removing the step from the ladder support device.
Figure 11:
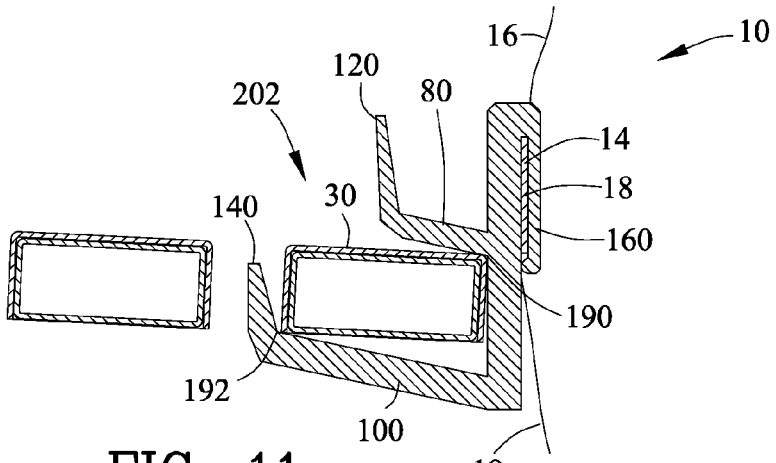
FIG. 11 is a sectional view along line 11-11 in FIG. 8.
Figure 13:
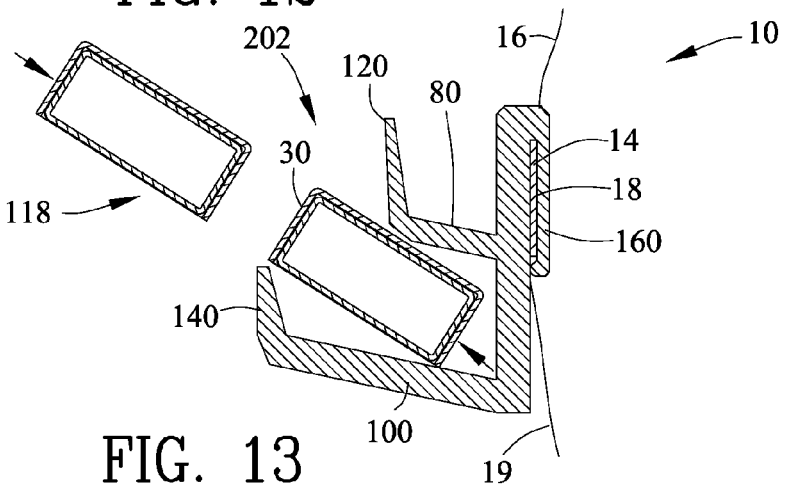
FIG. 13 is a view similar to FIG. 11, illustrating the retainer channel permitting vertical displacement of the ladder relative to the base plate only upon positioning the ladder in a generally angled orientation.
Figure 15:
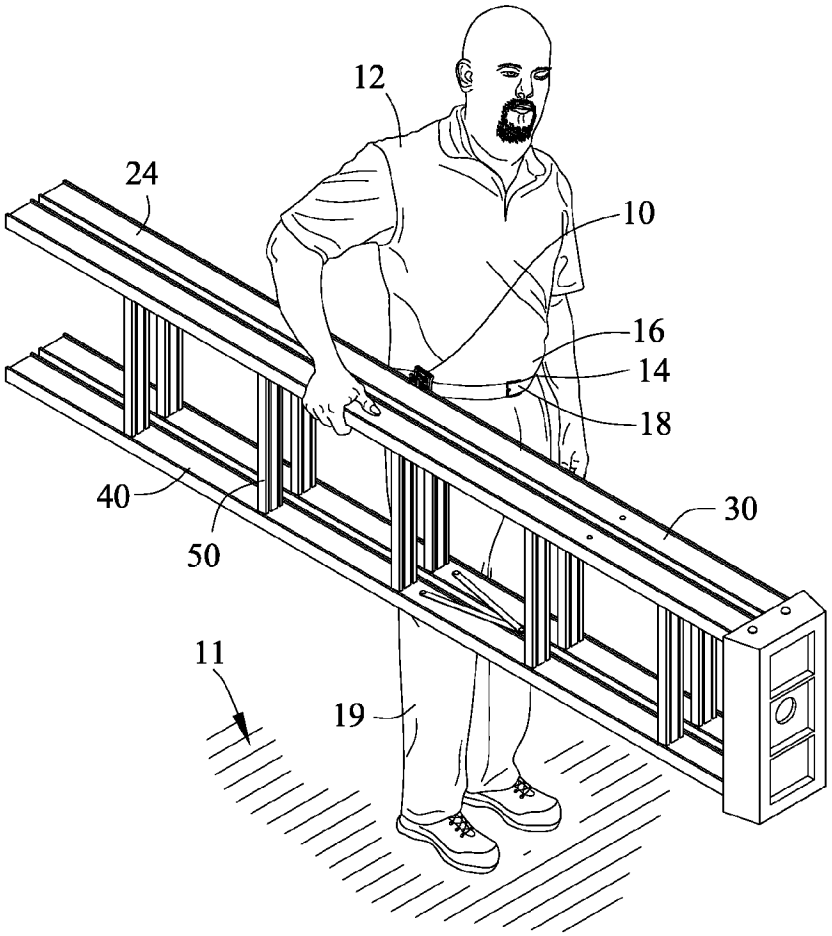
FIG. 15 is a view similar to FIG. 8, illustrating the second carriage of the ladder support device engaging a stringer of a step ladder.
Figure 14:
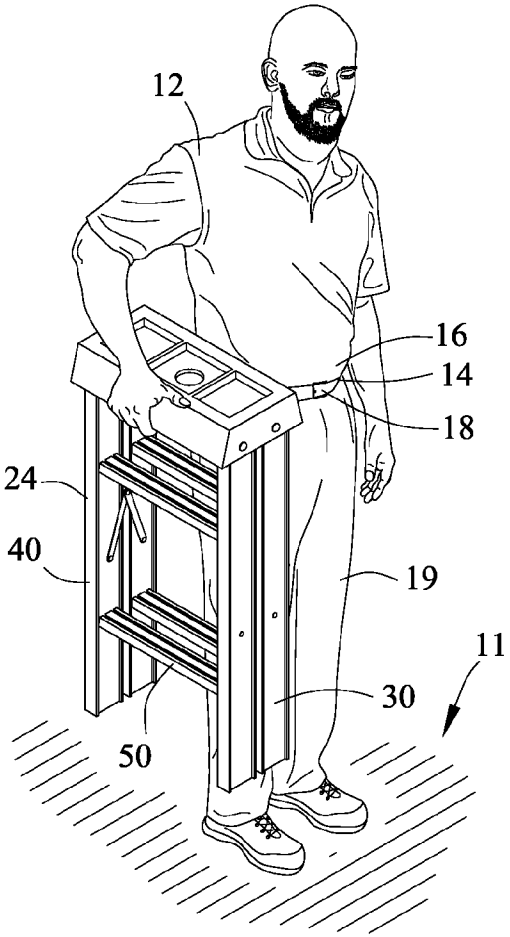
FIG. 14 is a view similar to FIG. 7, illustrating the first carriage of the ladder support device engaging a step of a step ladder.
Figure 16:
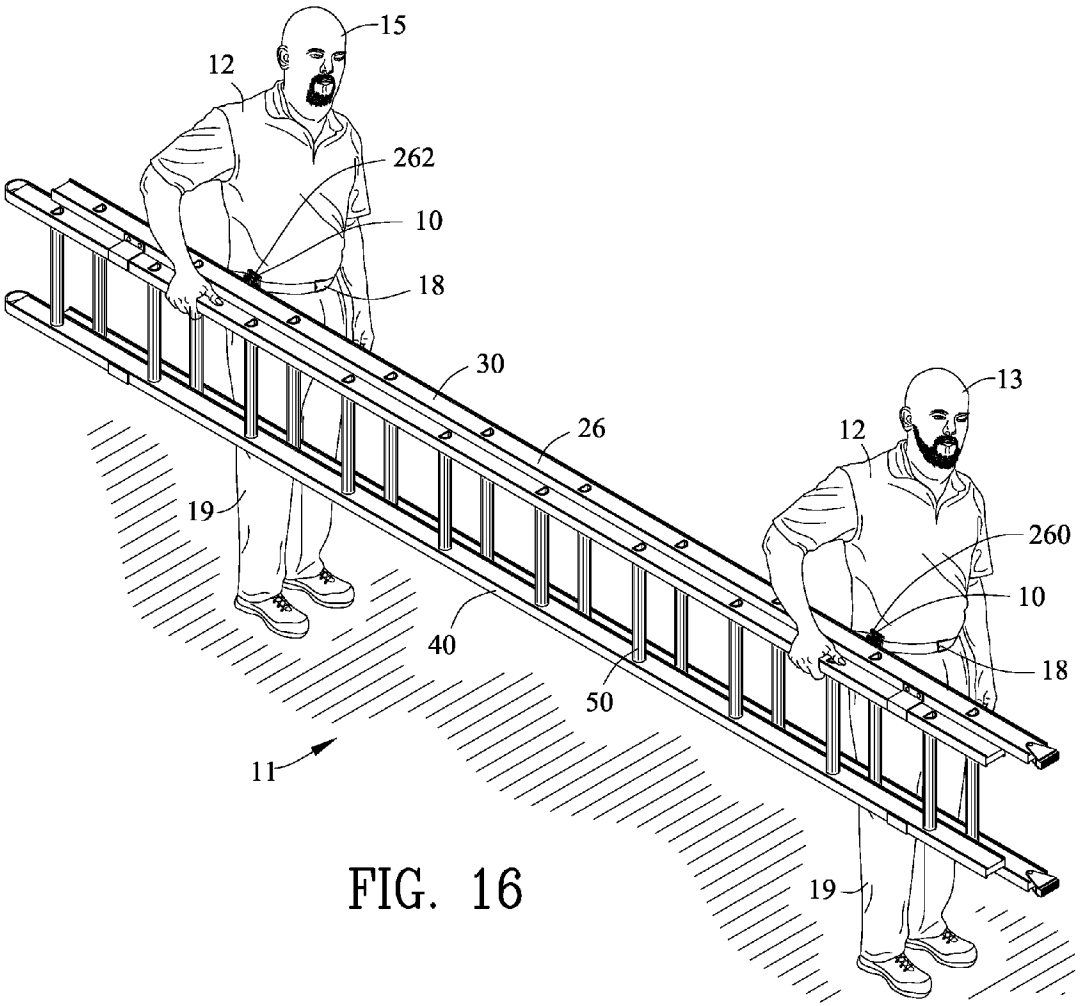
FIG. 16 is an isometric view of a first individual having a first ladder support device and a second individual having a second ladder support device wherein the second carriage of the first ladder support device and the second ladder support device engage a stringer of an extension ladder.

FIGS. 1-16 illustrate a ladder support device 10 for engaging a ladder 20. The ladder includes a first stringer 30 and a second stringer 40 coupled by a plurality of steps 50. The first stringer 30 and the second stringer 40 have a height (32, 42), a width (34, 44) and a depth (36,46). The steps have a height 52, a width 54 and a depth 56. As shown in FIGS. 7 and 8, ladder 20 may include a collapsible extension ladder 22. As shown in FIGS. 14 and 15, ladder 20 may include a step ladder 24. As shown in FIG. 16, ladder 20 may include an extension ladder 26.

As best shown in FIGS. 7-16, an individual 12 has a waistband 14 encircling a waste 16 of the individual 12. The waistband 14 may include but is not limited to a belt 18, trousers 19 or the combination thereof. As further explained below, the ladder support device 10 facilitates the individual 12 in transporting the ladder 20 over a surface 11.

The ladder supporting device 10 comprises a base plate 60 having an exterior plate surface 62, an interior plate surface 64, an upper edge 66, a lower edge 68, a first side edge 70 and a second side edge 72. A first hanger plate 80 extends from the exterior plate surface 62 of the base support plate 60 and has an upper surface 82, a lower surface 84, an outer edge 86, a first side edge 88 and a second side edge 90. A second hanger plate 100 extends from the exterior plate surface 62 of the base support plate 60 and has an upper surface 102, a lower surface 104, an outer edge 106, a first side edge 108 and a second side edge 110.

A first retainer plate 120 extends from the outer edge 86 of the first hanger plate 80 and has an exterior plate surface 122, an interior plate surface 124, an upper edge 126, a first side edge 128 and a second side edge 130. A second retainer plate 140 extends from the outer edge 86 of the second hanger plate 100 and has an exterior plate surface 142, an interior plate surface 144, an upper edge 146, a first side edge 148 and a second side edge 150.

As best shown in FIGS. 9-13, in order to secure the ladder support device 10 to the individual 12, the ladder support device 10 includes a clip plate 160. The clip plate 160 extends from the upper edge 66 of the base plate 60 and has an exterior clip surface 162, an interior clip surface 164, and a lower edge 166. The base plate 60 and the clip plate 160 define a clip groove 168 for receiving the waistband 14 and securing the base plate 60 to the individual 12. The clip plate 160 may further include a keeper rib 170, extending from the internal clip surface 162 for positioning adjacent the interior plate surface 64 of the base plate 60. The keeper rib 170 assists in preventing the waistband 14 from being removed from the clip proved 168.

The base plate 60, the first hanger plate 80 and the first retainer plate 120 define a first carriage 92 for engaging the step 50 of the ladder 20. The base plate 60, the second hanger plate 100 and the second retainer plate 140 define a second carriage 112 for engaging the first stringer 30 or the second stringer 40 of the ladder 20.

Figure 12:
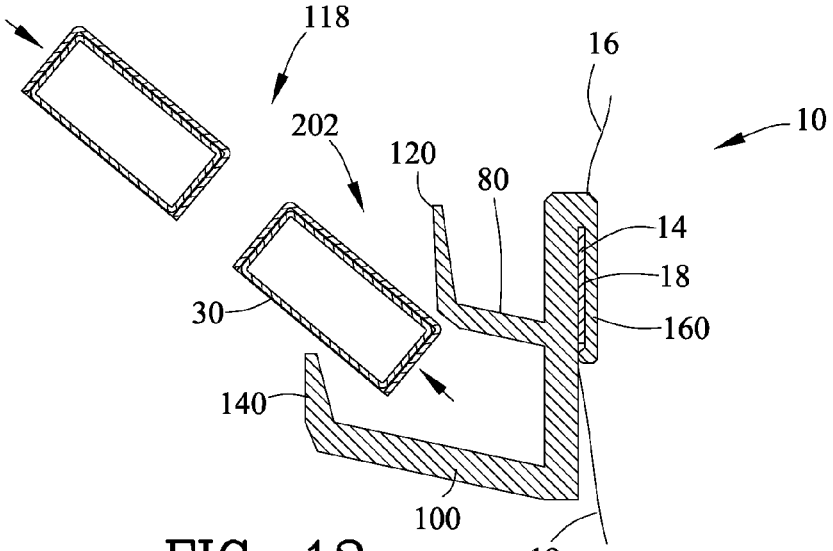
FIG. 12 is a view similar to FIG. 11, illustrating the guiding channel permitting the inputting or outputting of the first stringer or the second stringer into or from the retainer channel only upon positioning the ladder in a general angled orientation.

Preferably, the first hanger plate 80 has a generally intermediate position 94 relative to the upper edge 66 of the base plate 60 and the lower edge 68 of the base plate 60. The second hanger plate 100 has a generally adjacent position 114 relative to the lower edge 68 of the base plate 60. The generally intermediate position 94 and the generally adjacent position 114 define a guiding channel 96 between the first retainer plate 120 and the second retainer plate 140 and a retainer channel 116 between the first hanger plate 80 and the second hanger plate 100. The guiding channel 96 permits the inputting or outputting of the first stringer 30 or the second stringer 40 into or from the retainer channel 116 only upon positioning the ladder 20 in a general angled orientation 118 as shown in FIG. 12. The retainer channel 116 permits vertical displacement of the ladder 20 relative to the base plate 60 only upon positioning the ladder 20 in the generally angled orientation 118 as shown in FIG. 13.

Preferably, the first hanger plate 80 has a first plate length 180 that is generally commensurate with the width 54 of the step 50 of the ladder 20. The second hanger plate 100 has a second plate length 182 that is generally commensurate with the width (34, 44) of the first stringer 30 and the second stringer 40. As best shown FIGS. 5 and 9-13, the second plate length 182 is greater than the first plate length 180. A first acute angle 184 is located between the upper surface 82 of the first hanger plate 80 and the base plate 60 for maintaining the step 50 adjacent to the base plate 60. A second acute angle 186 is located between the upper surface 102 of the second hanger plate 100 and the base plate 60 for maintaining the first stringer 30 or the second stringer 40 adjacent to the base plate 60. The first hanger plate 80 and the second hanger plate 100 define a parallel orientation 188.

The lower surface 84 of the first hanger plate 80 and the exterior plate surface 62 of the base plate 60 define an interior engaging angle 190. The upper surface 102 of the second hanger plate 100 and the interior plate surface 144 of the second retainer plate 140 define an exterior engaging angle 192. The interior engaging angle 190 and the exterior engaging angle 192 contact with the first stringer 30 or the second stringer 40 for wedging the ladder 20 within the second carriage 112.

A first obtuse angle 194 is between the upper surface 82 of the first hanger plate 80 and the first retainer plate 120 for defining a first tapering passage 196 between the first retainer plate 120 and the base plate 60. The first tapering passage 196 assisting in position a step 50 within the first carriage 92 by providing an increased dimension at the opening of the first tapering passage 196 and a deceased dimension at the bottom of the first tapering passage 196. Similarly, a second obtuse angle 200 is between the upper surface 102 of the second hanger plate 100 and the second retainer plate 140 for defining a second tapering passage 202 between the second retainer plate 140 and the base plate 60. The second tapering passage 202 assisting in position either the first stringer 30 or the second stringer 40 within the second carriage 112 by providing an increased dimension at the opening of the second tapering passage 202 and a deceased dimension at the bottom of the second tapering passage 202.

As best shown in FIGS. 4, 5 and 9-13, the first retainer plate 120 has a first plate height 210 that is generally commensurate with the depth 56 of the step 50 of the ladder 20. The second retainer plate 140 has a second plate height 212 that is generally commensurate with the depth of the first stringer 30 and the second stringer 40. Preferably, the first plate height 210 is greater than the second plate height 212.

Figure 1:
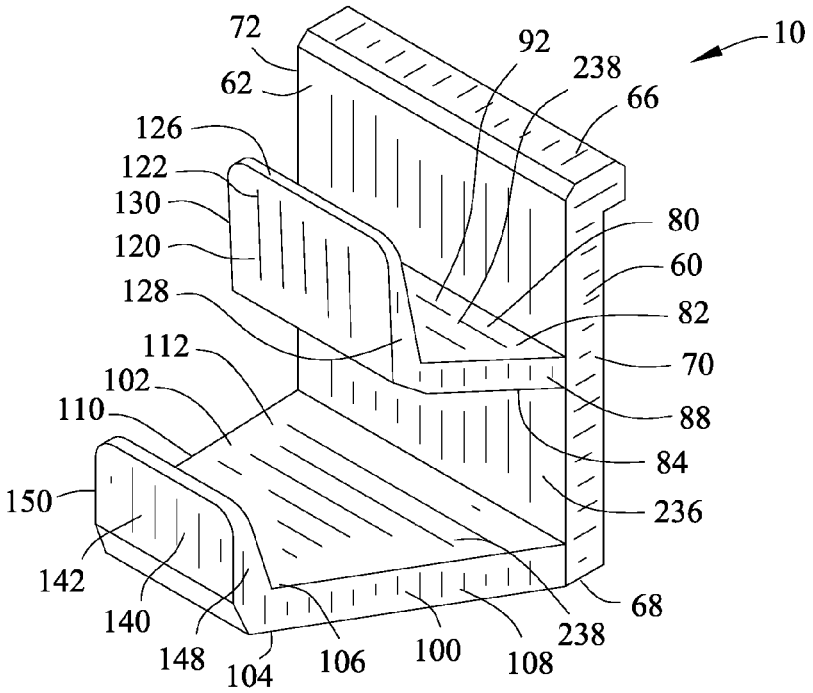
FIG. 1 is a front isometric view of a ladder support device of the present invention.
Figure 2:
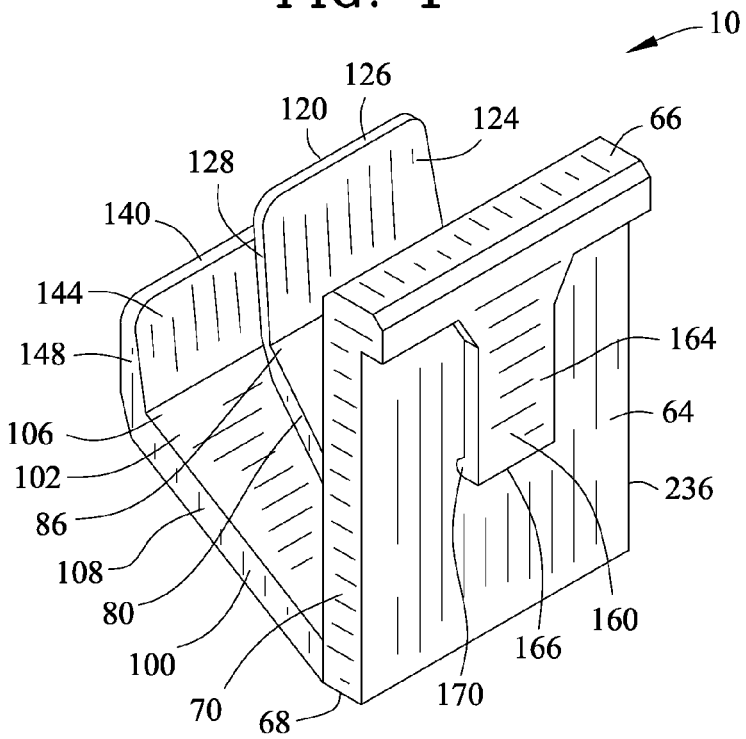
FIG. 2 is a rear isometric view of FIG. 1.
Figure 3:
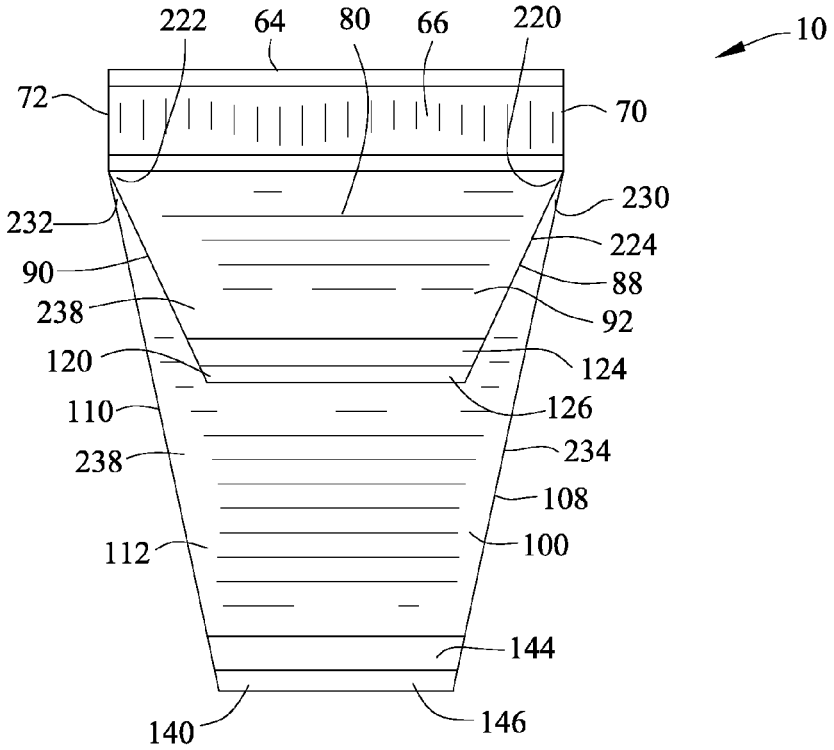
FIG. 3 is a top view of FIG. 1.
Figure 4:
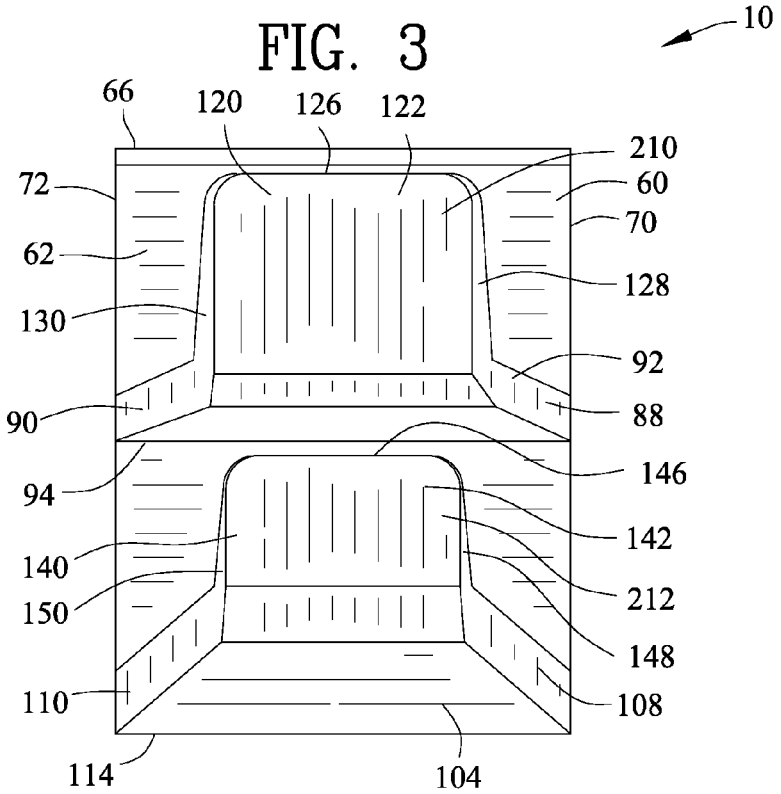
FIG. 4 is a front view of FIG. 1.
Figure 6:
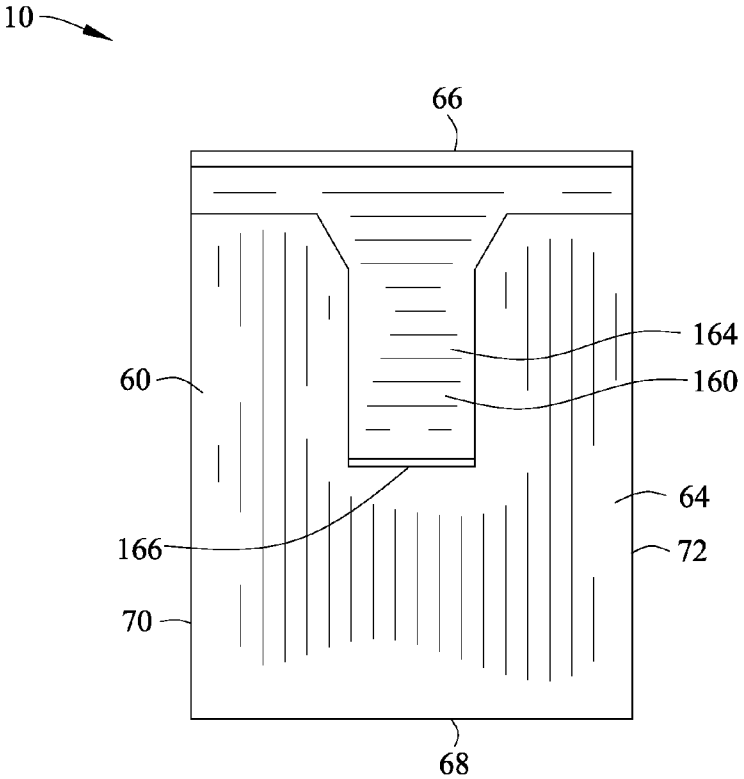
FIG. 6 is a rear view of FIG. 1.
Figure 5:
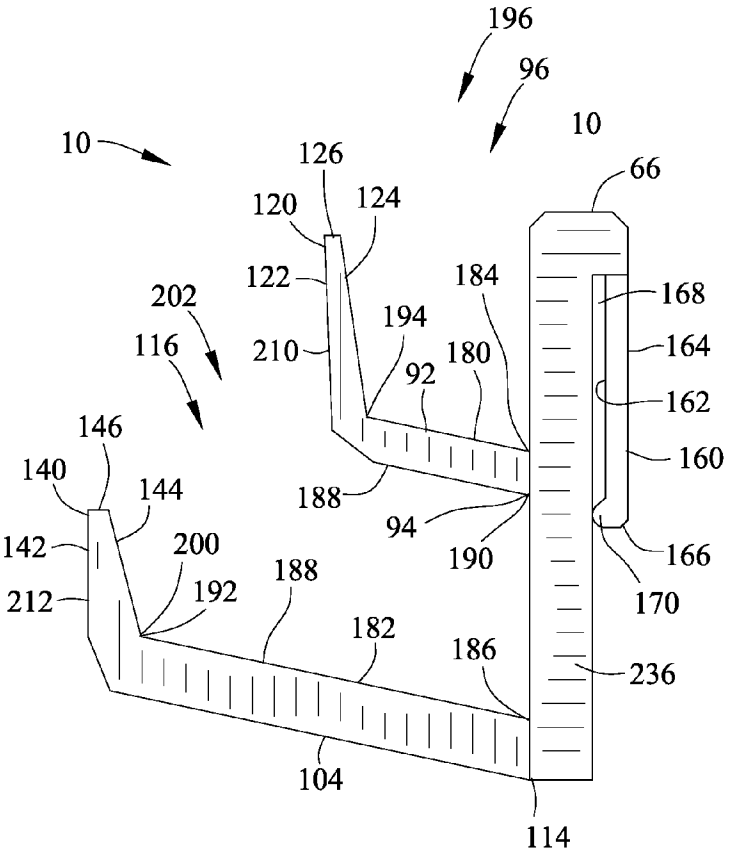
FIG. 5 is a side view of FIG. 1.

As best shown in FIGS. 3 and 4, a primary acute angle 220 is positioned between the first side edge 88 of the first hanger plate 80 and the exterior plate surface 62 of the base plate 60 and a secondary acute angle 222 is positioned between the second side edge 90 of the first hanger plate 80 and the exterior plate surface 62 of the base plate 60 for defining a first narrowing plate width 224. Similarly, a primary acute angle 230 is positioned between the first side edge 108 of the second hanger plate 100 and the exterior plate surface 62 of the base plate 60 and a secondary acute angle 232 is positioned between the second side edge 110 of the second hanger plate 100 and the exterior plate surface 62 of the base plate 60 for defining a second narrowing plate width 234. Preferably, the first narrowing plate width 224 is greater than the second narrowing plate width 234.

The base plate 60, the first hanger plate 80, the first retainer plate 120, the second hanger plate 100, the second retainer plate 140 and the clip plate 160 are preferably constructed from an integral one piece unit 236. The ladder support device 10 may be constructed from a polymeric, metallic or other rigid substance or combination thereof.

FIG. 16 illustrates a first individual 13 having a first ladder support device 260 and a second individual 15 having a second ladder supporting device 262. In this configuration, the weight of the extension ladder 26 may be divided between the first individual 13 and the second individual 15. Furthermore, the extension ladder 26 is more easily maneuvered and controlled by utilizing the first ladder support device 260 and the second ladder supporting device 262. The reduction in the overall bearing weight that the first individual 13 and the second individual 15 must carry allows for more easily transportation of the extension ladder 26 over the surface 11. In addition, the improved maneuverability and control of the extension ladder 26 allows for more easily transportation of the extension ladder 26 over the surface 11.

The first ladder support device 260 and the second ladder supporting device 262 are utilized by engaging the first stringer 30 or the second stringer 40 within the second carriage 112 of the first ladder support device 260 and the first stringer 30 or the second stringer 40 engaging within the second carriage 112 of the second ladder support device 262.

Figure 17:
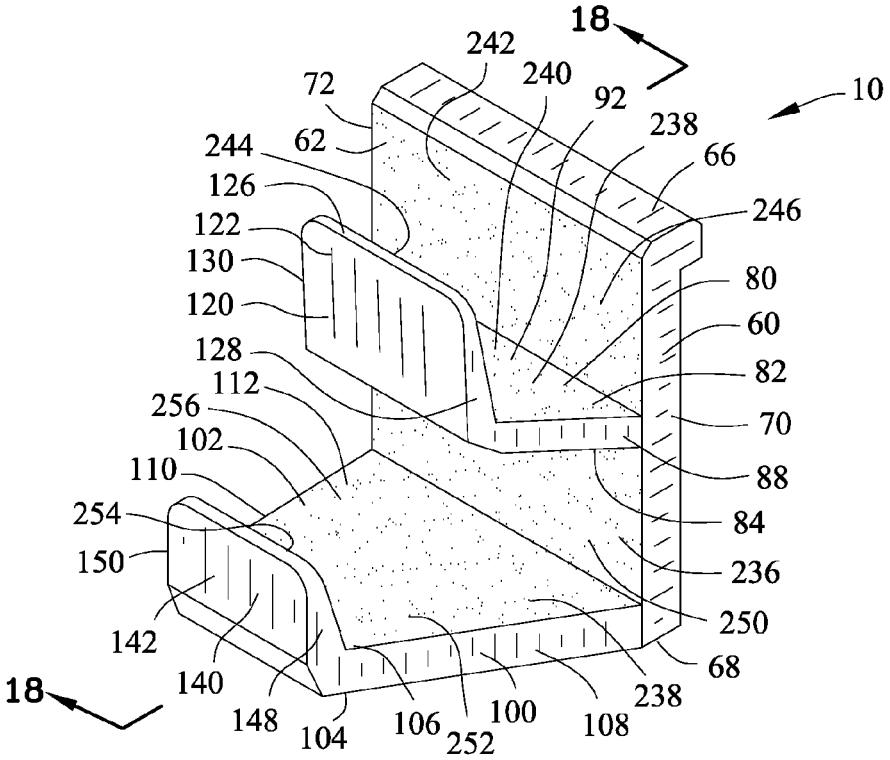
FIG. 17 is a view similar to FIG. 1 illustrating the first carriage 92 and the second carriage 112 including a first generally U-shaped polymeric layer and a second generally U-shaped polymeric layer respectively for preventing displacement of the ladder 20 relative to the ladder support device 10 during engagement between the ladder support device 10 and the ladder 20.
Figure 18:
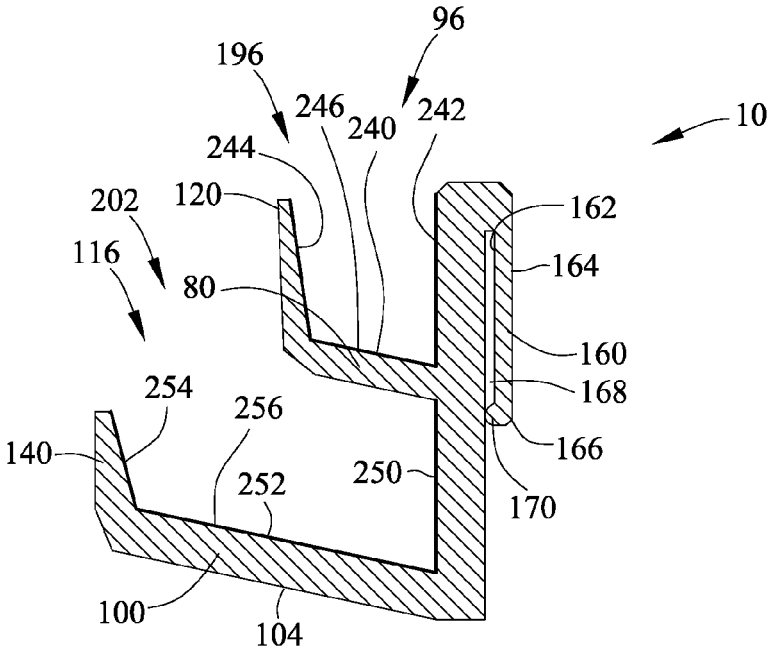
FIG. 18 is a sectional view along line 18-18 in FIG. 17.

As shown in FIGS. 17 and 18, the ladder support device 10 may include one or more polymeric layer(s) 238 for preventing displacement of the ladder 20 relative to the ladder support device 10 during engagement between the ladder support device 10 and the ladder 20. More specifically, the exterior plate surface 62 of the base plate 60 includes a first base polymeric layer 240. The upper surface 82 of the first hanger plate 80 includes a first hanger polymeric layer 242. The internal plate surface 124 of the first retainer plate 120 includes a first retainer polymeric layer 244. The combination of the first base polymeric layer 240, the first hanger polymeric layer 242 and the first retainer polymeric layer 244 define a first, generally U-shaped polymeric layer 246. The first generally U-shaped polymeric layer 246 engages with the step 50 of the ladder 24 for increasing the coefficient of friction between the step 50 and the first carriage 92, and therefore prevents displacement of the ladder 20 relative to the ladder support device 10.

The exterior plate surface 62 of the base plate 60 includes a second base polymeric layer 250. The upper surface 102 of the second hanger plate 100 includes a second hanger polymeric layer 252. The internal plate surface 144 of the second retainer plate 140 includes a second retainer polymeric layer 254. The combination of the second base polymeric layer 250, the second hanger polymeric layer 252 and the second retainer polymeric layer 254 define a second generally U-shaped polymeric layer 256. The second generally U-shaped polymeric layer 256 engages with either the first stringer 30 or the second stringer 40 of the ladder 24 for increasing the coefficient of friction between first stringer 30 or the second stringer 40 and the second carriage 112, and therefore prevents displacement of the ladder 20 relative to the ladder support device 10. The polymeric layer 238 may include but not limited to natural rubber, synthetic rubber or other elastomer materials. The polymeric layer 238 may be coupled by an adhesive, fusion, mechanical fasteners or other securing means.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A ladder support device for engaging a ladder, the ladder including a first stringer and a second stringer coupled by a plurality of steps, the first stringer and the second stringer having a height, a width and a depth, the steps having a height, a width and a depth, an individual transporting the ladder over a surface, the individual having a waistband encircling a waist of the individual, the ladder supporting device, comprises:

a base plate having an exterior plate surface, an interior plate surface, an upper edge, a lower edge, a first side edge and a second side edge;

a first hanger plate extending from said exterior plate surface of said base support plate and having an upper surface, a lower surface, an outer edge, a first side edge and a second side edge;

a second hanger plate extending from said exterior plate surface of said base support plate and having an upper surface, a lower surface, an outer edge, a first side edge and a second side edge;

a first retainer plate extending from said outer edge of said first hanger plate and having an exterior plate surface, an interior plate surface, an upper edge, a first side edge and a second side edge;

a second retainer plate extending from said outer edge of said second hanger plate and having an exterior plate surface, an interior plate surface, an upper edge, a first side edge and a second side edge;

a clip plate extending from said upper edge of said base plate and having an exterior clip surface, an interior clip surface, and an lower edge;

said base plate and said clip plate defining a clip groove for receiving the waistband and securing the base plate to the individual;

said base plate, said first hanger plate and said first retainer plate defining a first carriage for engaging the step of the ladder;

said base plate, said second hanger plate and said second retainer plate defining a second carriage for engaging the first stringer or the second stringer of the ladder;

said first hanger plate has a first plate length that is generally commensurate with the width of the step of the ladder;

said second hanger plate has a second plate length that is generally commensurate with the width of the first stringer and the second stringer; and said second plate length greater than said first plate length.

2. A ladder support device for engaging a ladder as set forth in claim 1, wherein said first hanger plate has a generally intermediate position relative to said upper edge of said base plate and said lower edge of said base plate;

said second hanger plate has a generally adjacent position relative to said lower edge of said base plate;

said generally intermediate position and said generally adjacent position defining a guiding channel between said first retainer plate and said second retainer plate and a retainer channel between said first hanger plate and said second hanger plate;

said guiding channel permitting inputting or outputting of the first stringer or the second stringer into or from said retainer channel only upon positioning the ladder in a general angled orientation; and said retainer channel permitting vertical displacement of the ladder relative to said base plate only upon positioning the ladder in a generally angled orientation.

3. A ladder support device for engaging a ladder as set forth in claim 1, wherein said first hanger plate has a first plate length that is generally commensurate with the width of the step of the ladder;

said second hanger plate has a second plate length that is generally commensurate with the width of the first stringer and the second stringer; and said second plate length greater than said first plate length.

4. A ladder support device for engaging a ladder as set forth in claim 1, further including a first acute angle between said upper surface of said first hanger plate and said base plate for maintaining the step adjacent to said base plate; and a second acute angle between said upper surface of said second hanger plate and said base plate for maintaining the first stringer or the second stringer adjacent to said base plate.

5. A ladder support device for engaging a ladder as set forth in claim 1, further including a first acute angle between said upper surface of said first hanger plate and said base plate for maintaining the step adjacent to said base plate;

a second acute angle between said upper surface of said second hanger plate and said base plate for maintaining the first stringer or the second stringer adjacent to said base plate; and said first hanger plate and said second hanger plate defining a parallel orientation.

6. A ladder support device for engaging a ladder as set forth in claim 1, further including a first acute angle between said upper surface of said first hanger plate and said base plate for maintaining the step adjacent to said base plate;

a second acute angle between said upper surface of said second hanger plate and said base plate for maintaining the first stringer or the second stringer adjacent to said base plate;

said lower surface of said first hanger plate and said exterior plate surface of said base plate defining an interior engaging angle;

said upper surface of said second hanger plate and said interior plate surface of said second retainer plate defining an exterior engaging angle; and said interior engaging angle and said exterior engaging angle contacting with the first stringer or the second stringer for wedging the ladder within said second carriage.

7. A ladder support device for engaging a ladder as set forth in claim 1, further including a first obtuse angle between said upper surface of said first hanger plate and said first retainer plate for defining a first tapering passage between said first retainer plate and said base plate; and a second obtuse angle between said upper surface of said second hanger plate and said second retainer plate for defining a second tapering passage between said second retainer plate and said base plate.

8. A ladder support device for engaging a ladder as set forth in claim 1, wherein said first retainer plate has a first plate height that is generally commensurate with the depth of the step of the ladder;

said second retainer plate has a second plate height that is generally commensurate with the depth of the first stringer and the second stringer; and said first plate height greater than said second plate height.

9. A ladder support device for engaging a ladder as set forth in claim 1, further including a primary acute angle between said first side edge of said first hanger plate and said exterior plate surface of said base plate and a secondary acute angle between said second side edge of said first hanger plate and said exterior plate surface of said base plate for defining a first narrowing plate width; and a primary acute angle between said first side edge of said second hanger plate and said exterior plate surface of said base plate and a secondary acute angle between said second side edge of said second hanger plate and said exterior plate surface of said base plate for defining a second narrowing plate width.

10. A ladder support device for engaging a ladder as set forth in claim 1, wherein said base plate, said first hanger plate, said first retainer plate, said second hanger plate, said second retainer plate and said clip plate being constructed from an integral one piece unit.

11. A ladder support device for engaging a ladder as set forth in claim 1, further including a first hangar polymeric layer coupled to said upper surface of said first hanger plate for increasing the coefficient of friction between the step and said first carriage and preventing displacement of the ladder relative to the ladder support device; and a second hanger polymeric layer couple to said upper surface of said second hanger plate for increasing the coefficient of friction between the first stringer or the second stringer and said second carriage and preventing displacement of the ladder relative to the ladder support device.

12. A ladder support device for engaging a ladder as set forth in claim 1, further including a first base polymeric layer coupled to said exterior plate surface of said base plate;

a first hangar polymeric layer coupled to said upper surface of said first hanger plate;

a first retainer polymeric layer couple to said internal plate surface of said first retainer plate;

said first base polymeric layer, said first hangar polymeric layer and said first retainer polymeric layer defining a first generally U-shaped polymeric layer;

said first generally U-shaped polymeric layer engaging with said step of said ladder for increasing the coefficient of friction between the step and said first carriage and preventing displacement of the ladder relative to the ladder support device;

a second base polymeric layer couple to said exterior plate surface of said base plate;

a second hanger polymeric layer couple to said upper surface of said second hanger plate;

a second retainer polymeric layer couple to said internal plate surface of said second retainer plate;

said second base polymeric layer, said second hanger polymeric layer and said second retainer polymeric layer defining a second generally U-shaped polymeric layer; and said second generally U-shaped polymeric layer engaging with the first stringer or the second stringer of the ladder for increasing the coefficient of friction between the first stringer or the second stringer and said second carriage and preventing displacement of the ladder relative to the ladder support device.

13. A ladder support device coupling to an individual, the individual having a waistband encircling a waist of the individual, the ladder supporting device, comprises:

a base plate having an exterior plate surface, an interior plate surface, an upper edge, a lower edge, a first side edge and a second side edge;

a first hanger plate extending from said exterior plate surface of said base support plate and having an upper surface, a lower surface, an outer edge, a first side edge and a second side edge;

a second hanger plate extending from said exterior plate surface of said base support plate and having an upper surface, a lower surface, an outer edge, a first side edge and a second side edge;

a first retainer plate extending from said outer edge of said first hanger plate and having an exterior plate surface, an interior plate surface, an upper edge, a first side edge and a second side edge;

a second retainer plate extending from said outer edge of said second hanger plate and having an exterior plate surface, an interior plate surface, an upper edge, a first side edge and a second side edge;

a clip plate extending from said upper edge of said base plate and having an exterior clip surface, an interior clip surface, and an lower edge;

said base plate and said clip plate defining a clip groove for receiving the waistband and securing the base plate to the individual;

a ladder including a first stringer and a second stringer coupled by a plurality of steps;

said first stringer and said second stringer defining a height, a width and a depth;

said plurality of steps defining a height, a width and a depth;

said base plate, said first hanger plate and said first retainer plate defining a first carriage for engaging said step of said ladder;

said base plate, said second hanger plate and said second retainer plate defining a second carriage for engaging said first stringer or said second stringer of said ladder;

said first hanger plate has a generally intermediate position relative to said upper edge of said base plate and said lower edge of said base plate;

said second hanger plate has a generally adjacent position relative to said lower edge of said base plate;

said generally intermediate position and said generally adjacent position defining a guiding channel between said first retainer plate and said second retainer plate and a retainer channel between said first hanger plate and said second hanger plate;

said guiding channel permitting inputting or outputting of said first stringer or said second stringer into or from said retainer channel only upon positioning said ladder in a general angled orientation;

said retainer channel permitting vertical displacement of said ladder relative to said base plate only upon positioning said ladder in a generally angled orientation;

a first acute angle between said upper surface of said first hanger plate and said base plate for maintaining said step adjacent to said base plate; and a second acute angle between said upper surface of said second hanger plate and said base plate for maintaining said first stringer or said second stringer adjacent to said base plate.

14. A ladder support device coupling to an individual, the individual having a waistband encircling a waist of the individual, the ladder supporting device, comprises:

a base plate having an exterior plate surface, an interior plate surface, an upper edge, a lower edge, a first side edge and a second side edge;

a first hanger plate extending from said exterior plate surface of said base support plate and having an upper surface, a lower surface, an outer edge, a first side edge and a second side edge;

a second hanger plate extending from said exterior plate surface of said base support plate and having an upper surface, a lower surface, an outer edge, a first side edge and a second side edge;

a first retainer plate extending from said outer edge of said first hanger plate and having an exterior plate surface, an interior plate surface, an upper edge, a first side edge and a second side edge;

a second retainer plate extending from said outer edge of said second hanger plate and having an exterior plate surface, an interior plate surface, an upper edge, a first side edge and a second side edge;

a clip plate extending from said upper edge of said base plate and having an exterior clip surface, an interior clip surface, and an lower edge;

said base plate and said clip plate defining a clip groove for receiving the waistband and securing the base plate to the individual;

a ladder including a first stringer and a second stringer coupled by a plurality of steps;

said first stringer and said second stringer defining a height, a width and a depth;

said plurality of steps defining height, a width and a depth;

said base plate, said first hanger plate and said first retainer plate defining a first carriage for engaging said step of said ladder;

said base plate, said second hanger plate and said second retainer plate defining a second carriage for engaging said first stringer or said second stringer of said ladder;

a first acute angle between said upper surface of said first hanger plate and said base plate for maintaining said step adjacent to said base plate;

a second acute angle between said upper surface of said second hanger plate and said base plate for maintaining said first stringer or said second stringer adjacent to said base plate;

said first hanger plate and said second hanger plate defining a parallel orientation;

said lower surface of said first hanger plate and said exterior plate surface of said base plate defining an interior engaging angle;

said upper surface of said second hanger plate and said interior plate surface of said second retainer plate defining an exterior engaging angle; and said interior engaging angle and said exterior engaging angle contacting with said first stringer or said second stringer for wedging said ladder within said second carriage.

* * * * *